United States Patent [19]

Ebstein et al.

[11] 3,970,304

[45] July 20, 1976

[54] BASKETBALL BACKBOARD AND SUPPORT

[75] Inventors: John W. Ebstein, Roslyn Heights; Mario Cambardella, Manhasset, both of N.Y.

[73] Assignee: Gabriel Industries, Inc., New York, N.Y.

[22] Filed: Mar. 17, 1975

[21] Appl. No.: 559,189

[52] U.S. Cl. ..... 273/1.5 R; 248/224; 248/300; 273/102 S

[51] Int. Cl.² ..... A63B 63/02

[58] Field of Search ..... 273/1.5 R, 102 S, 105 R, 273/105 A, 103; 248/224, 300, 242, 281

[56] References Cited

UNITED STATES PATENTS

| | | | |
|---|---|---|---|
| 2,731,228 | 1/1956 | Baldwin | 248/300 |
| 2,831,689 | 4/1958 | Marsh | 273/1.5 R |
| 3,092,387 | 6/1963 | Wagner | 273/1.5 R |
| 3,530,996 | 9/1970 | Schaffer | 248/224 |
| 3,802,702 | 4/1974 | Pulley | 273/1.5 R |

*Primary Examiner*—Richard C. Pinkham
*Assistant Examiner*—Marvin Siskind
*Attorney, Agent, or Firm*—Seidel, Gonda & Goldhammer

[57] ABSTRACT

A basketball backboard is provided with notches on a rear surface thereof so that it may be quickly and easily suspended from fastener members on a mounting bracket. With the backboard thusly suspended from the bracket, nuts on the fastener members are tightened to secure the backboard to the bracket.

10 Claims, 4 Drawing Figures

FIG. 1
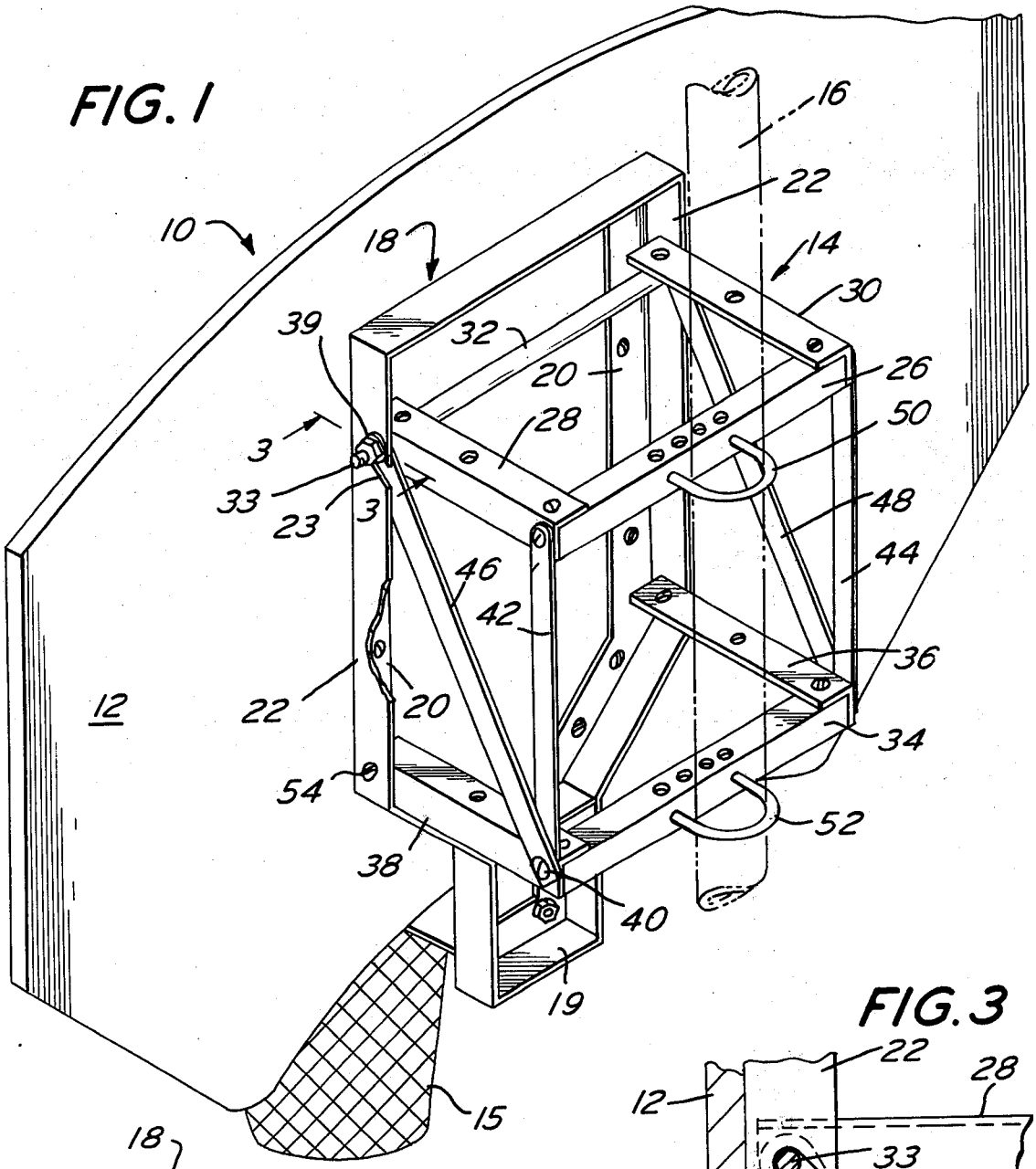
FIG. 3
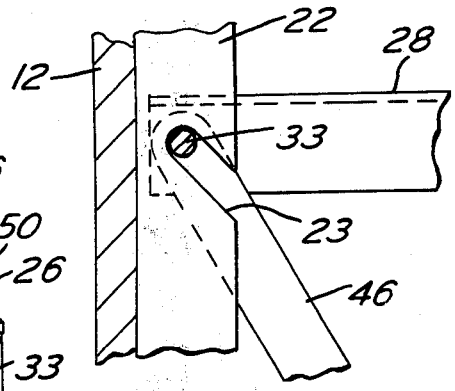
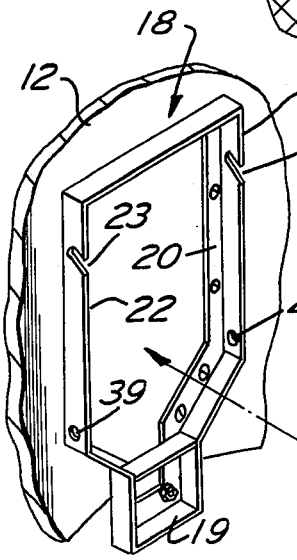
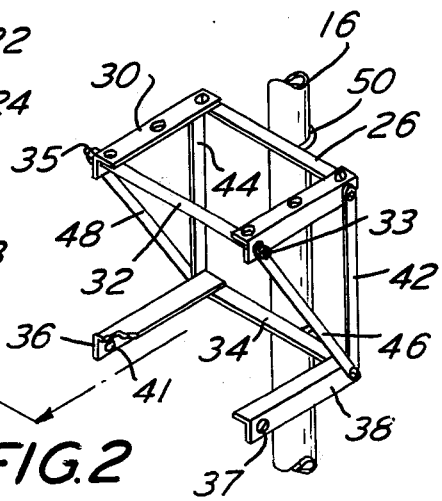
FIG. 2
FIG. 4
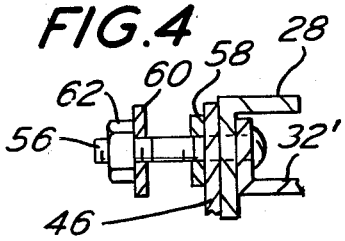

BASKETBALL BACKBOARD AND SUPPORT

BACKGROUND

A wide variety of brackets have been proposed heretofore in connection with mounting a basketball backboard to a support such as a pole, a wall, or a roof at the desired elevation above a playing surface. Such prior art devices usually are in the form of a kit which requires the components of the bracket to be assembled and which usually requires a scissor-type arrangement. A scissor-type arrangement of brackets presents or involves a time consuming chore in orientating one bracket with respect to the other so that their ends are at the same elevation for securement to the backboard.

The present invention is directed to a basketball backboard and support. The backboard is adapted to have a net on one side. A bracket is provided for the other side of the backboard. The bracket is constructed in a manner so that it may facilitate mounting the backboard on a support at a desired elevation above a playing surface.

The backboard is provided with an upper pair of notches in a reinforcing flange projecting therefrom and generally perpendicular thereto. The bracket is provided with an upper pair of fastener members lying in a generally horizontal plane and spaced a predetermined distance apart so that each notch may receive one of said fastener members. A fastener is provided for each fastener member for removably securing it in its associated notch.

The structural interrelationship between the bracket and backboard as described above facilitates rapid coupling of the backboard to its mounting bracket. With the bracket attached to its support, such as a pole, roof, wall, or the like, it takes only a few seconds to simultaneously position each fastener member in its associated notch. The weight of the backboard is thereby immediately supported by the bracket. Hence, a fastener for each fastener member may be tightened without the operator having to support or manipulate the backboard.

The bracket is preferably rectangular or box-like in shape to provide a rigid bracket wherein the fastener members are spaced apart a predetermined distance corresponding to the predetermined spacing of the notches on the preassembled backboard.

In addition to minimizing the assembly work by the person installing the backboard, the structural interrelationship of the bracket utilized in connection with the present invention minimizes cost of the same. Thus, the present invention facilitates use of L-shaped channel members and flat members instead of U-shaped channel members utilized in prior art devices. The fastener members preferably project in opposite directions from the bracket and preferably are at opposite ends of a strap for reinforcing the bracket.

It is an object of the present invention to provide a novel basketball backboard and support.

It is another object of the present invention to provide a basketball backboard and support bracket structurally interrelated in a manner which facilitates the ease and speed with which they may be coupled together for purposes of installation.

Other objects will appear hereinafter.

For the purpose of illustrating the invention, there is shown in the drawings a form which is presently preferred; it being understood, however, that this invention is not limited to the precise arrangements and instrumentalities shown.

FIG. 1 is a perspective view of the backboard and its support bracket.

FIG. 2 is an exploded view of the apparatus shown in FIG. 1.

FIG. 3 is a sectional view taken along the line 3—3 in FIG. 1.

FIG. 4 is a sectional view of an alternative arrangement for the fastener members.

Referring to the drawing in detail, wherein like numerals indicate like elements, there is shown in FIG. 1 a basketball backboard and support in accordance with the present invention designated generally as 10. A backboard 12 which may be of conventional construction from a rigid material such as fiberglass, metal, composition board or a laminate of nonmetallic materials is removably secured to the mounting bracket 14. For purposes of illustration, bracket 14 is of the pole type so that it may be removably secured to a vertical pole 16 as the desired elevation above a playing surface. The backboard 12 supports a net 15 on one side thereof, namely the playing side.

On the rear side of the backboard 12, as shown in FIG. 1, a metal angle reinforcing brace 18 is secured to the central portion thereof. Brace 18 has a flange 20 on its inner periphery and fastened to backboard 12. Brace 18 has a peripheral flange 22 which is generally perpendicular to the backboard 12. Parallel portions of flange 22 have notches 23, 24 which are angled upwardly at an angle of about 45°. A depending extension 19 on brace 18 supports the ring for net 15.

The mounting bracket 14 is generally rectangular or box-like when viewed in top plan and/or in elevation. The bracket 14 is preferably preassembled and attached to the support such as pole 16 before the backboard 12 is removably attached thereto. The bracket 14 includes a mounting brace 26 which is preferably L-shaped in section and made from metal. Similarly shaped arm members 28 and 30 have one end secured to the brace 26 and project forwardly therefrom. The free end of said arm members 28 and 30 are interconnected by a horizontal strap 32 thereby defining a rigid rectangular configuration when viewed from above. Strap 32 is provided with threaded end portions of a smaller transverse dimension to define fastener members 33, 35 each of which is adapted to be received in one of said notches 23, 24.

A second mounting brace 34 is parallel to and spaced from the brace 26. Arm members 36 and 38 are secured to the brace 34 and project forwardly therefrom. The arm members 36, 38 are parallel to and of the same length as the arm members 28, 30. Brace 34 and arm members 36, 38 are preferably made of the same material and are of the same configuration as the brace 26.

The arm members 36 and 38 are not interconnected at their free ends. Arm member 38 is secured to the brace 34 by a fastener 40. A similar fastener is provided for the arm member 36. Arm member 38 may pivot slightly in a downward direction about the axis of fastener 40 so that hole 37 may be aligned with hole 39 on the flange 22. Likewise, arm member 36 may pivot slightly so that hole 41 may be aligned with hole 43 on the flange 22.

The arm members 28 and 38 are vertically interconnected by a vertical strap 42 having a length generally corresponding to the distance between the notch 23 and hole 39. A similar vertical strap 44 interconnects the arm members 30 and 36. The length of the strap 44 generally corresponds to the distance between the notch 24 and hole 43. Arm members 28 and 38 are also interconnected by the diagonal strap 46. Arm members 30 and 36 are also interconnected by the diagonal strap 48.

One end of the diagonal strap 46, namely the upper end in FIG. 1, is positioned between flange 22 and arm member 28. The fastener member 33 is provided with a nut (not shown) which secures strap 32 to the flange 22 with arm member 28 and strap 46 therebetween, as well as nut 39. In like manner, strap 32, flange 22 and strap 48 are secured to the arm member 30 at the end thereof remote from the brace 26. The fastener members 33, 35 project in opposite directions away from their respective arm members and lie in a generally horizontal plane so as to be generally parallel to the backboard 12 and spaced apart by a distance corresponding to the spacing between the notches 23, 24.

The brace members 26 and 34 are provided with means for securing the bracket 14 to a support. When the support is in the form of a pole such as pole 16, the attaching means may take the form of the U-shaped bolts 50, 52 removably secured to the braces 26, 34, respectively, as shown in FIG. 1.

The preassembled bracket 14 is attached to the support at the desired elevation above a playing surface. Such mounting generally involves positioning the bracket 14 so that the brace 34 is about 9-10 feet above the playing surface which may be a floor in a building or a paved surface on the ground constituting part of an outdoor playing court.

The backboard 12 is then lifted and the fastener members 33, 35 positioned in their respective notches 23, 24 on the flange 22. The arm members 36, 38 are preferably pivotable within a slight range of about 5°–10° so that holes 37, 41 may be aligned with holes 39, 43 respectively. Then a fastener 54 is positioned and secured in the aligned holes. See FIG. 1. Such pivotable movement of arm members 36, 38 is not essential but is desirable since it insures proper orientation notwithstanding slight deviations from manufacturing tolerances. Thereafter, the nut 39 on each fastener member 33, 35 is tightened to thereby complete the installation of the backboard 12.

It will be noted that the person installing the backboard 12 need not support the same as so0n as the fastener members 33, 35 are received in their respective notches 23, 24 on the flange 22. As a result thereof, the person installing the backboard is free to use both hands for tightening the nuts 39 on fastener members 33, 35 and for manipulating fasteners 54.

In FIG. 4, there is illustrated an alternative embodiment for the fastener members whereby they are discrete bolts. Bolt 56 performs the function of fastener member 33 by extending through a flange on strap 32′, a hole in arm member 28, a hole in strap 46, and is adapted to be received in notch 23. As shown in FIG. 4 a nut 58 is threaded to bolt 56 and spaced from washer 60 and nut 62 to thereby define a gap along bolt 56. The gap is at least as thick as flange 22. A similar discrete bolt is provided at the other end of strap 32′ for receipt in notch 24.

When it is desired to secure the bracket 14 to a vertical surface such as a wall, fasteners are utilized in a manner so that they extend through the holes in the braces 26, 34 which are presently occupied by the U-bolts 50, 52 respectively. Bracket 14 may have angularly disposed portions for mounting backboard 12 on an angled roof.

The above described construction is particularly adapted for use with backboards 12 which are nonmetallic. The brace 18 reinforces the backboard 12 in the playing area, supports the ring for net 15, and constitutes the means for coupling the backboard 12 to its mounting bracket 14 in a rapid easy manner.

The present invention may be embodied in other specific forms without departing from the spirit or essential attributes thereof and, accordingly. reference should be made to the appended claims, rather than to the foregoing specification as indicating the scope of the invention.

We Claim:

1. Apparatus comprising a basketball backboard adapted to have a net on one side, a mounting bracket for cooperation with the other side of said backboard for mounting the same on a support at a desired elevation above a playing surface, said backboard having a pair of upwardly inclined notches on a flange member projecting therefrom and generally perpendicular thereto, said bracket having a pair of fastener members lying in a generally horizontal plane and spaced a predetermined distance apart corresponding to the spacing of said notches so that each notch may receive one of said fastener members, a fastener for each fastener member for securing it in its associated notch, and additional means including an opening on said flange member for cooperation with mating structure on said bracket for removably securing said backboard to said bracket at an elevation below the elevation of said notches.

2. Apparatus in accordance with claim 1 wherein said bracket includes a vertically disposed strap on each side thereof, each vertical strap having a length corresponding generally to the distance between one notch and said opening on said flange member.

3. Apparatus in accordance with claim 2 wherein said bracket is rectangular in plan view defined by parallel arm members extending toward the backboard and interconnected at one end by a strap adjacent the backboard and by a brace at their other end, said brace having means for securing said bracket to a support.

4. Apparatus in accordance with claim 1 wherein said notches are on spaced vertically disposed portions of said flange member, said flange member having portions secured to said backboard.

5. Apparatus in accordance with claim 4 wherein said flange member extends to a position below the lower edge of said backboard and supports a ring for said net.

6. Apparatus in accordance with claim 1 including:

a brace having means thereon for attaching said mounting bracket to a support; and an angularly disposed strap on said mounting bracket and having one end secured thereto by one of said fastener members.

7. Apparatus comprising a basketball backboard having a net disposed on one side thereof, a mounting bracket for mounting said backboard on a support at a desired elevation above a playing surface, said backboard having a reinforcing member with spaced vertically disposed portions generally perpendicular to said backboard and projecting from said other side of said backboard, each of said vertically disposed portions having an upwardly inclined notch, said mounting bracket having a pair of aligned fastener members generally parallel to said backboard, said fastener members being spaced apart by a distance corresponding to the distance between said pair of notches so that each notch may receive one of said fastener members, said mounting bracket having a pair of aligned holes on horizontally disposed portions thereof below the elevation of said fastener members, said backboard having a pair of aligned holes in said vertically disposed portions below the location of said notches for cooperative coupling with said holes on said bracket, said mounting bracket including a vertically disposed strap having a length corresponding generally to the vertical distance between the notch and hole on one vertically disposed portion, said reinforcing member having portions generally parallel to said backboard and secured thereto, and said mounting bracket including at least one brace having means thereon for securing the mounting bracket to a support.

8. Apparatus in accordance with claim 7 wherein said fastener members are discrete bolts, each bolt having a pair of fasteners threadedly secured thereto.

9. Apparatus in accordance with claim 8 wherein said mounting bracket including a brace, an angularly disposed strap and a horizontally disposed strap on said mounting bracket, one end of each of said straps being secured to one of said vertically disposed portions of said reinforcing member by one of said bolts, and said brace having means thereon for attaching the mounting bracket to a support.

10. Apparatus in accordance with claim 7 wherein said mounting bracket includes a horizontally disposed strap adjacent and generally parallel to said backboard, said strap being connected at its ends to said fastener members.

* * * * *